United States Patent [19]

Herabakka

[11] Patent Number: 4,830,336

[45] Date of Patent: May 16, 1989

[54] ARRANGEMENT IN A HOISTING DEVICE, ESPECIALLY FOR A DERRICK

[76] Inventor: Jacob Herabakka, Grannes, N-4050 Sola, Norway

[21] Appl. No.: 150,403

[22] PCT Filed: May 29, 1987

[86] PCT No.: PCT/NO87/00042

§ 371 Date: Mar. 31, 1988

§ 102(e) Date: Mar. 31, 1988

[87] PCT Pub. No.: WO87/07673

PCT Pub. Date: Dec. 17, 1987

[30] Foreign Application Priority Data

Jun. 3, 1986 [NO] Norway ..... 862202

[51] Int. Cl.[4] ..... B66F 7/12

[52] U.S. Cl. ..... 254/95

[58] Field of Search ..... 187/8.47, 8.5, 19; 403/2; 192/129 R, 129 A, 144, 150; 405/198; 254/95-97, 89 R, 105-111

[56] References Cited

U.S. PATENT DOCUMENTS

| | | | |
|---|---|---|---|
| 2,781,185 | 2/1957 | Robbins . | |
| 3,743,247 | 7/1973 | Willke et al. | 254/95 |
| 3,867,989 | 2/1975 | Hisey et al. . | |
| 4,027,854 | 6/1977 | Mouton, Jr. . | |
| 4,341,373 | 7/1982 | Mouton, Jr. . | |
| 4,386,757 | 6/1983 | Vezole | 254/95 |
| 4,453,858 | 6/1984 | Guiader | 254/95 |
| 4,482,272 | 11/1984 | Colin | 405/198 |
| 4,512,553 | 4/1985 | Dunham et al. | 254/95 |
| 4,627,768 | 12/1986 | Thomas et al. | 254/95 |

FOREIGN PATENT DOCUMENTS

| | | | |
|---|---|---|---|
| 55-122911 | 9/1980 | Japan | 405/198 |
| 2155520A | 9/1985 | United Kingdom . | |

*Primary Examiner*—Robert C. Watson

*Attorney, Agent, or Firm*—Bernard R. Gans

[57] ABSTRACT

Arrangement in a hoisting device, especially for a derrick (1) comprising two parallel vertical derrick components (3, 4), each of which carrying a rack rail (10) along which the hoisting device (6) can move vertically by means of a driving means (**6*a*, 6*b*) which is arranged on each derrick component (3, 4) and which via gear wheels (8, 9) engages the rack rails (10), the hoisting device (6) comprising a transverse supporting member (18) extending between the two driving means (6*a*, 6*b*). In order to avoid breakdown of the hoisting device and associated structural parts, the invention provides a transverse supporting member (18) which in the area of each driving means (6*a*, 6*b*) comprises a pivotable bearing (30, 31) which during irregular skew loading on the two driving means (6*a*, 6*b*) allows for a relatively largely inclined position of the supporting member (18), the supporting member (18) in the area of one of the driving means (6*a*) also comprising a bracing means (34) which during normal parallel operation of the driving means (6*a*, 6*b*) stiffens the supporting member, but which during irregular operation is brought to collapse in order to allow the bearing arrangement (30, 31) to be effective for rendering the supporting member (18**) an inclined position which prevents breakdown of machinery and associated structural members.

9 Claims, 2 Drawing Sheets

ARRANGEMENT IN A HOISTING DEVICE, ESPECIALLY FOR A DERRICK

The present invention relates to an arrangement in a hoisting device, especially for a derrick comprising two parallel vertical derrick components, each of which carries a rack rail along which the hoisting device can move vertically by means of a respective driving means provided for each derrick component and via toothed wheels engaging the rack rails, the hoisting means comprising a transverse supporting member extending between said two driving means.

In such hoisting devices, the transverse supporting member will be loaded with heavy weights suspended therefrom, for example the weight represented by a drilling string.

If one of the gear transmissions should jam during the lowering of the hoisting device including such large loads, the overall hoisting device including rack rails and the main structure would have a breakdown.

The object of the present invention is therefore to provide a device of the type mentioned in the preamble, which reduces the risk of breakdown upon unbalanced loading, there also being aimed for a system which supervise the various variations of loadings during a drilling operation.

According to the invention the object is achieved in that the transverse supporting member in the area of each driving means comprises a rotatable bearing which at abnormal unbalanced loadings on the two driving means allows a relatively large slanted position on the supporting member, and that the supporting member in the area of one of the driving means also comprises a bracing means which during normal parallel operation of the driving means stiffens the supporting member, but which during abnormal operation is made to collapse to allow a slanted position of the transverse member.

Preferably the bracing means will have a connection to a load measuring device which supervises the loadings on the bracing means, and which when a given load is exceeded actuates the mechanical brakes for the driving means.

If the driving means should still be moving after the engagement of the mechanical brakes, the bracing means would be loaded so heavily that it will break, a fact which involves that the transverse supporting member no longer represents a rigid structure, but an articulated connection allowing for a certain difference in level between the driving means without involving any breakdown of hoisting machinery including rack rails and main structure.

Further features and advantages of the present invention will appear from the patent claims, and will in the following be further discussed in connection with the attached drawings illustrating an embodiment of the present arrangement.

Figure 1:
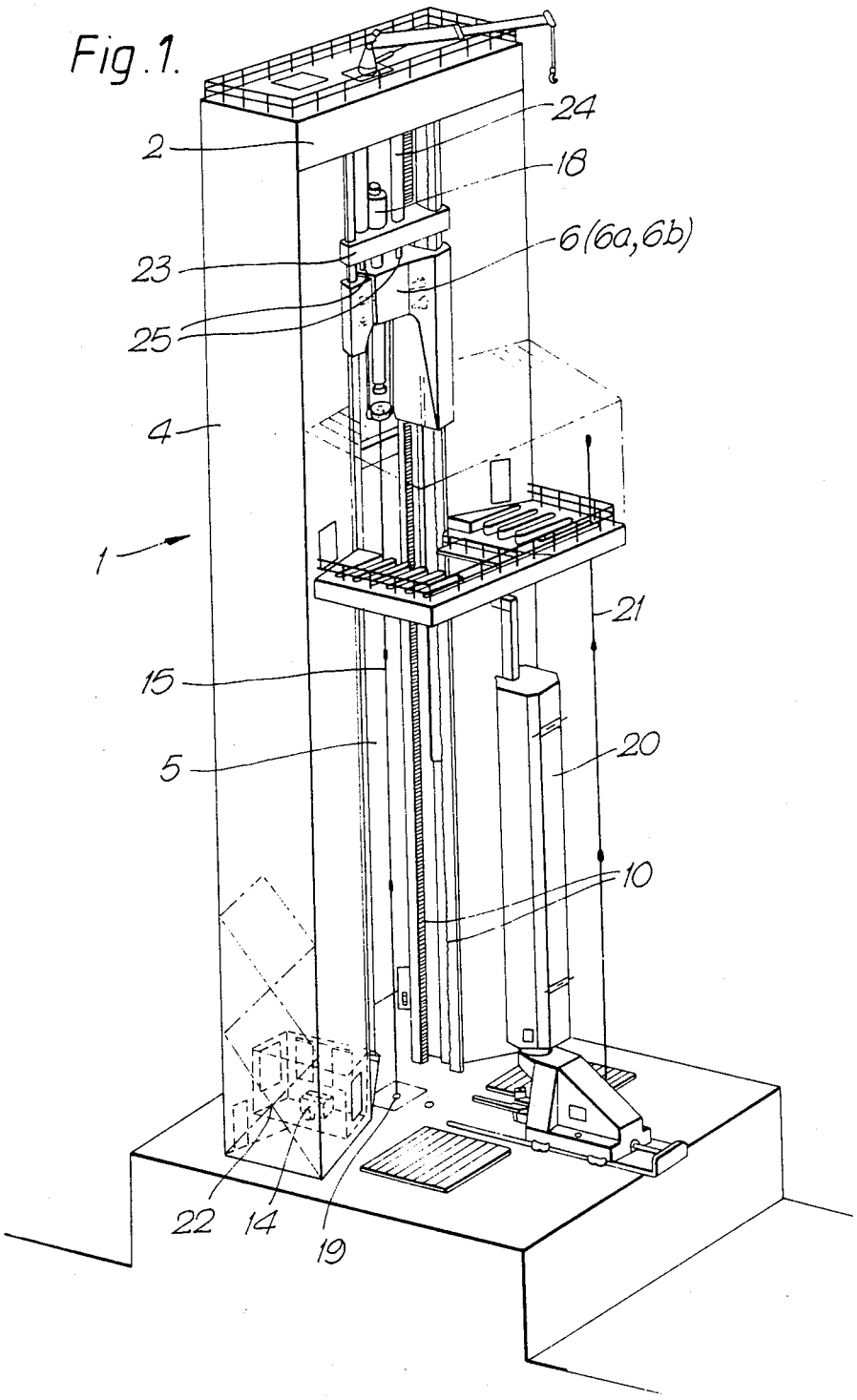
FIG. 1 illustrates perspectively a derrick structure including associated equipment, installed on a platform.
Figure 2:
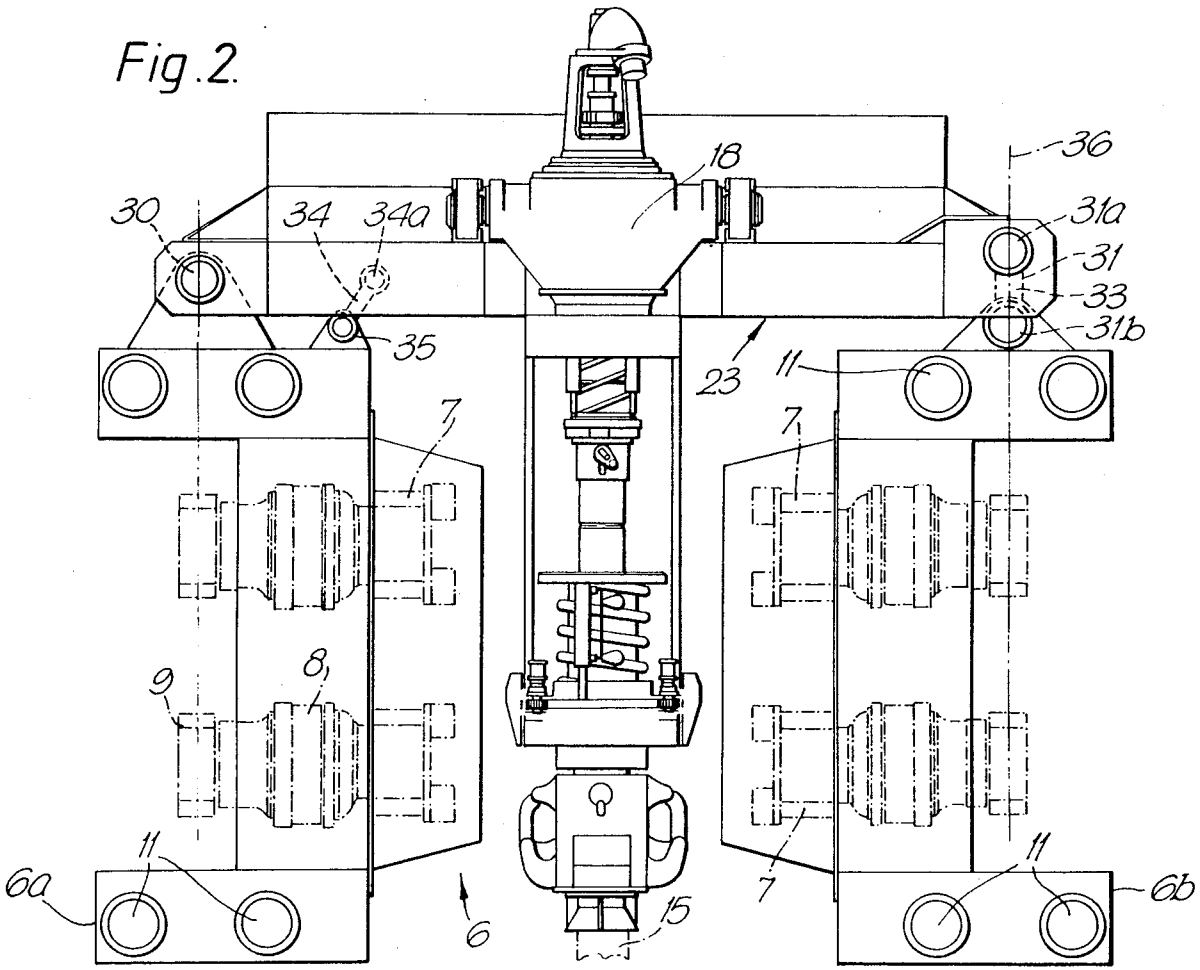
FIG. 2 is a view at a larger scale of an embodiment of the device according to the invention.

In FIG. 1 there is illustrated a derrick structure which is generally designated by reference numeral 1, and which comprises an upper traverse 2 and two parallel derrick components 3 and 4, respectively, which together with the traverse 2 define a space 5 for accomodating a vertically movable hoisting device 6, which is further illustated in FIG. 2.

The hydraulic hoisting device 6 comprises for example four hydraulic motors 7, each of which via a transmission gear 8 drives its own gear wheel 9, which in turn is in engagement with rack rails 10 mounted along the derrick components 3 and 4, respectively.

The braking of the hydraulic hoisting device 6 takes place by means of for example mechanical brakes, which are adapted to be activated automatically if the hydraulic pressure should disappear. The shafts of the gear wheels 8 and 9 can be supported in ball bearings and work preferably in a closed oil bath.

In FIG. 2 there are also illustrated guiding wheels 11 cooperating with the rack rails 10 for horizontal guidance of the hoisting device 6.

FIG. 1 also illustrates a control desk 14 provided in a control room 22, as well as a drilling string 15 which at its upper end is conneted to a drilling machine 18, and which at the other end extands down into a drilling center 19. The drilling machine 18 is mounted on a transverse supporting member 23 extending between the two driving means **6*a* and 6*b* included in the hoisting device 6. Further, the derrick comprises a pipe handling apparatus 20 for handling pipe lengths 21. Reference numeral 25** refers to guiding and connection means between the drilling and hoisting machinery.

The transverse supporting member 18 is in the area of each driving means **6*a* and 6*b*, respectively, pivotably supported, i.e. in the area of the driving means 6*a* by means of a first pivoting means 30 rendering a single pivoting point, whereas in the area of the second driving means 6*b* it is pivotably supported by means of a second pivoting means 31 comprising two pivoting points 31*a* and 31*b* connected by means of a link 33. Without any bracing, the transverse supporting member 18 will thus take a slanted position relative to the horizontal if the two driving means 6*a* and 6*b* should be displaced unevenly relative to each other. However, in the area of the driving means 6*a*, there is provided a bracing means 34 which during normal parallel operation of the driving means 6*a*, 6*b* will stiffen the supporting member 18, but which during irregular operation is brougth to collapse for thereby allowing a slanted position of the supporting member 18**.

The bracing means 34 is approximately connected to a measuring means 35 which for example can be provided in the area of the bracing means 34, and which when a certain loading is exceeded, activates the mechanical brakes of the driving means **6*a* and 6*b***.

Preferably, the bracing means 34 may comprise a shear pin extending from the housing of the first driving means, here driving means **6*a*, and to the supporting member 18, said shear pin at its one end being connected to a shear tap 34*a***.

When the hoisting device 6 is running up and down between the derrick components 3 and 4, the supporting member 18 will have large weigths suspending therefrom, for example weigths corresponding to a drilling string. During normal operation the hoisting means **6*a* and 6*b* will travel along the two pairs of rack rails 10 which are mounted 5 meters apart, and it is especially important that the driving means 6*a* and 6*b*** follow each other and are given approximately equal loading during lowering and raising operations. Such a rack rail hoisting device can especially during lowering of the hoisting device including large loads, be subjected to wedging of one of the gear transmissions, which involves a risk for breakdown of the overall hoisting device including rack rails and main structure.

Since the transverse supporting member 18 has been provided with articulated connections 30 and 31 as well as bracing means 34 cooperating with a measuring means, the risk of breakdown will be reduced to a remarkable degree. During normal operation the measuring means will register any skew loadings and actuate all the mechanical brakes of the hydraulic motors if the loadings should exceed a certain limit. In case the brakes operate unevenly, such that the driving means **6*a* and 6*b* are displaced relative to each other as regards a horizontal level, the shear tap 34*a* will be torn off and thereby allow that the transverse supporting member 18 can take an inclined position for thereby avoiding unnecessary loading on the gear transmission and rack rails. It is possible for the supporting member to take this inclined position because the pivotable bearing arrangement 31 including two pivoting points allows a displacement of the first end point of the supporting member away from the area of a normal vertical line 36** through the two said pivoting points.

The use of the shear tap **34*a*** involves that breakdown can be avoided during irregular operation, and the shear tap also contributes to a stiff structure during normal operation, such that the driving means including their hydraulic motors always will run in parallel along the two rack rail paths.

I claim:

1. A hoisting device (6) for use with a derrick (1) having parallel vertical derrick components (3, 4), each of said vertical derrick components (3, 4) having a rack rail (10), said hoisting device (6) comprising:

first and second driving means **(6*a*, 6*b*) for moving said hoisting device up and down said parallel vertical derrick components (3, 4)**;

each of said first and second driving means **(6*a*, 6*b*) including gear wheels (9) engaging said rack rails (10)**;

a transverse supporting member (18) extending between said first and second driving means **(6*a*, 6*b*), said transverse supporting member (18) having a first opposite end thereof with a first pivoting means (30) for pivotally engaging said first opposite end to said first driving means (6a) and a second opposite end thereof with a second pivoting means (31) for pivotally engaging said second opposite end to said second driving means (6*b*) so that said transverse supporting member (18) is (a) capable of remaining in a substantially horizontal position when said first and second driving means (6*a*, 6*b*) are at substantially the same height on said vertical derrick components (3, 4)** and (*b*) capable of moving to an inclined position when said first and second driving means **(6*a*, 6*b*) are at different heights on said vertical derrick components; and bracing means (34) for supporting said transverse supporting member (18) in said substantially horizontal position and for collapsing in order to allow said transverse supporting member (18)** to be disposed in said inclined position.

2. The hoisting device (6) of claim 1 further comprising measuring device means (35) for measuring loading on said bracing means (34) in order to activate mechanical brakes of said driving means **(6*a*, 6*b*)** when said loading exceeds a predetermined value.

3. The hoisting device (6) of claim 2 wherein said bracing means (34) comprises a shear pin extending from said first driving means **(6*a*) to said transverse supporting member (18), said shear pin having a shear tap (34) at the end thereof connected to said transverse supporting member (18)**.

4. The hoisting device (6) of claim 1 wherein said first pivoting means (30) comprises a single pivoting point and said second pivoting means (31) comprises two pivoting points **(31*a*, 31*b*), each of said two pivoting points (31*a*, 31*b*) at an opposite corresponding end of a link (33) connecting said second opposite end of said transverse supporting member (18) to said second driving means (6*b*) so that said bracing means (34) is capable of collapsing in order to allow said transverse supporting member (18) to be disposed in said inclined position and said link (33)** to be disposed in a non-vertical position.

5. The hoisting device (6) of claim 2 wherein said first pivoting means (30) comprises a single pivoting point and said second pivoting means (31) comprises two pivoting points **(31*a*, 31*b*), each of said two pivoting points (31*a*, 31*b*) at an opposite corresponding end of a link (33) connecting said second opposite end of said transverse supporting member (18) to said second driving means (6*b*) so that said bracing means (34) is capable of collapsing in order to allow said transverse supporting member (918) to be disposed in said inclined position and said link (33)** to be disposed in a non-vertical position.

6. The hoisting device (6) of claim 3 wherein said first pivoting means (30) comprises a single pivoting point and said second pivoting means (31) comprises two pivoting points **(31*a*, 31*b*), each of said two pivoting points (31*a*, 31*b*) at an opposite corresponding end of a link (33) connecting said second opposite end of said transverse supporting member (18) to said second driving means (6*b*) so that said bracing means (34) is capable of collapsing in order to allow said transverse supporting member (18) to be disposed in said inclined position and said link (33)** to be disposed in a non-vertical position.

7. The hoisting device (6) of claim 4 wherein each of said first and second driving means **(6*a*, 6*b*) includes guide wheel means (11) for guiding said hoisting device (1) on said vertical derrick components (3, 4), motor means (7) for driving said gear wheels (9) and transmission gears means (8) for engaging said motor means (7) to said gear wheels (9)**.

8. The hoisting device (6) of claim 5 wherein each of said first and second driving means **(6*a*, 6*b*) includes guide wheel means (11) for guiding said hoisting device (1) on said vertical derrick components (3, 4), motor means (7) for driving said gear wheels (9) and transmission gears means (8) for engaging said motor means (7) to said gear wheels (9)**.

9. The hoisting device (6) of claim 6 wherein each of said first and second driving means **(6*a*, 6*b*) includes guide wheel means (11) for guiding said hoisting device (1) on said vertical derrick components (3, 4), motor means (7) for driving said gear wheels (9) and transmission gears means (8) for engaging said motor means (7) to said gear wheels (9)**.

* * * * *